US012258971B1

(12) United States Patent
Moradnia et al.

(10) Patent No.: US 12,258,971 B1
(45) Date of Patent: Mar. 25, 2025

(54) FAN ASSEMBLY

(71) Applicant: Honda Motor Co., Ltd., Tokyo (JP)

(72) Inventors: Pirooz Moradnia, Dublin, OH (US); Jason A Widmer, Marysville, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 18/466,649

(22) Filed: Sep. 13, 2023

(51) Int. Cl.
*F04D 25/02* (2006.01)
*F04D 19/00* (2006.01)
*F04D 29/053* (2006.01)
*F04D 29/32* (2006.01)

(52) U.S. Cl.
CPC ..... *F04D 25/02* (2013.01); *F04D 19/002* (2013.01); *F04D 29/053* (2013.01); *F04D 29/326* (2013.01)

(58) Field of Classification Search
CPC ..... F04D 25/02; F04D 19/002; F04D 29/053; F04D 29/326; B60H 1/00521; F01D 5/03
See application file for complete search history.

(56) References Cited

U.S. PATENT DOCUMENTS 208,855 A * 10/1878 Schleicher et al. ... F04D 25/086 416/123
1,994,914 A * 3/1935 Jordan ..... F04D 25/105 416/100
2,289,106 A * 7/1942 Draucker ..... F02B 53/00 418/248
2,509,442 A * 5/1950 Matheisel ..... B63H 1/16 310/67 R
5,274,987 A * 1/1994 Wiener ..... A01D 34/73 56/14.8
10,605,249 B2 3/2020 Park et al.
2009/0175745 A1* 7/2009 Usami ..... F04D 25/166 415/228
2018/0100425 A1* 4/2018 Kim ..... F04D 17/04
2018/0187688 A1 7/2018 Defilippis
2022/0196022 A1* 6/2022 Kuppan ..... F04D 25/0606

FOREIGN PATENT DOCUMENTS

CN 206785734 U 12/2017
CN 109372776 A 2/2019
CN 112360773 A 2/2021
CN 112761985 A 5/2021
CN 213511284 U 6/2021
CN 215293029 U 12/2021
CN 215595949 U 1/2022
CN 216356269 U 4/2022

* cited by examiner

*Primary Examiner* — Aaron R Eastman
(74) *Attorney, Agent, or Firm* — Morgan Lincoln; American Honda Motor Co., Inc.

(57) ABSTRACT

A fan assembly includes a fan having a shroud having an inner surface defining a flow chamber and an outer surface defining a plurality of teeth arrayed circularly around a circumference of the shroud. The fan also includes a plurality of blades arranged circularly around a central axis of the fan and extending radially inwardly from the shroud towards the central axis of the fan. Each of the plurality of blades is arranged inside the flow chamber and includes an outer edge connected to the inner surface of the shroud. The fan assembly further includes a drive assembly arranged outside the shroud and operatively engaged with the plurality of teeth of the shroud to rotate the fan around the central axis.

11 Claims, 6 Drawing Sheets

FAN ASSEMBLY

BACKGROUND

The disclosed subject matter relates generally to a fan assembly. More particularly, the disclosed subject matter relates to a fan assembly having a drive assembly that minimizes the interference with the air flow generated by a fan.

Heat transfer system, generally, includes a heat exchanger and a fan arranged upstream or downstream of the heat exchanger to generate a flow of air that passes through the heat exchanger, and exchanges heat with the fluid flowing through the heat exchanger. Such fans generally include a hub and a plurality of blades extending radially outwardly from the hub and are rotated by a motor arranged inside the hub. However, the hub acts as a barrier for air flow and restricts the amount of air flow being provided to the heat exchanger, decreasing the overall efficiency of the heat transfer system, which is undesirable.

SUMMARY

In accordance with one embodiment of the present disclosure, a fan assembly is provided. The fan assembly includes a fan having a shroud having an inner surface defining a flow chamber and an outer surface defining a plurality of teeth arrayed circularly around a circumference of the shroud. The fan also includes a plurality of blades arranged circularly around a central axis of the fan and extending radially inwardly from the shroud towards the central axis of the fan. Each of the plurality of blades is arranged inside the flow chamber and includes an outer edge connected to the inner surface of the shroud. The fan assembly further includes a drive assembly arranged outside the shroud and operatively engaged with the plurality of teeth of the shroud to rotate the fan around the central axis.

In accordance with another embodiment of the present disclosure, a heat transfer system is provided. Th heat transfer system includes a heat exchanger and a fan configured to facilitate a flow of air through the heat exchanger. The fan includes a shroud having an inner surface defining a flow chamber and an outer surface defining a plurality of teeth arrayed circularly around a circumference of the shroud. The fan also includes a plurality of blades arranged circularly around a central axis of the fan and extending radially inwardly from the shroud towards the central axis of the fan. Each of the plurality of blades is arranged inside the flow chamber and includes an outer edge connected to the inner surface of the shroud. Moreover, the heat transfer system includes a drive assembly arranged outside the shroud and operatively engaged with the plurality of teeth of the shroud to rotate the fan around the central axis.

In accordance with yet a further embodiment of the present disclosure a fan assembly is disclosed. The fan assembly includes a fan having a shroud having an inner surface defining a flow chamber and an outer surface defining a plurality of teeth arrayed circularly around a circumference of the shroud. The fan also includes a plurality of blades arranged circularly around a central axis of the fan and extending radially inwardly from the shroud towards the central axis of the fan. Each of the plurality of blades is arranged inside the flow chamber and includes an outer edge connected to the inner surface of the shroud. Moreover, the fan assembly includes a drive assembly arranged outside the shroud and including a gear arranged outside the shroud and operatively coupled with the plurality of teeth of the shroud to facilitate a rotation of the fan around the central axis.

BRIEF DESCRIPTION OF THE DRAWINGS

Certain embodiments of the present disclosure will be better understood from the following description taken in conjunction with the accompanying drawings in which.

DETAILED DESCRIPTION OF EXEMPLARY EMBODIMENTS

A few inventive aspects of the disclosed embodiments are explained in detail below with reference to the various figures. Exemplary embodiments are described to illustrate the disclosed subject matter, not to limit its scope, which is defined by the claims. Those of ordinary skill in the art will recognize a number of equivalent variations of the various features provided in the description that follows. Embodiments are hereinafter described in detail in connection with the views and examples of FIGS. 1-6B, wherein like numbers indicate the same or corresponding elements throughout the views.

Figure 1:
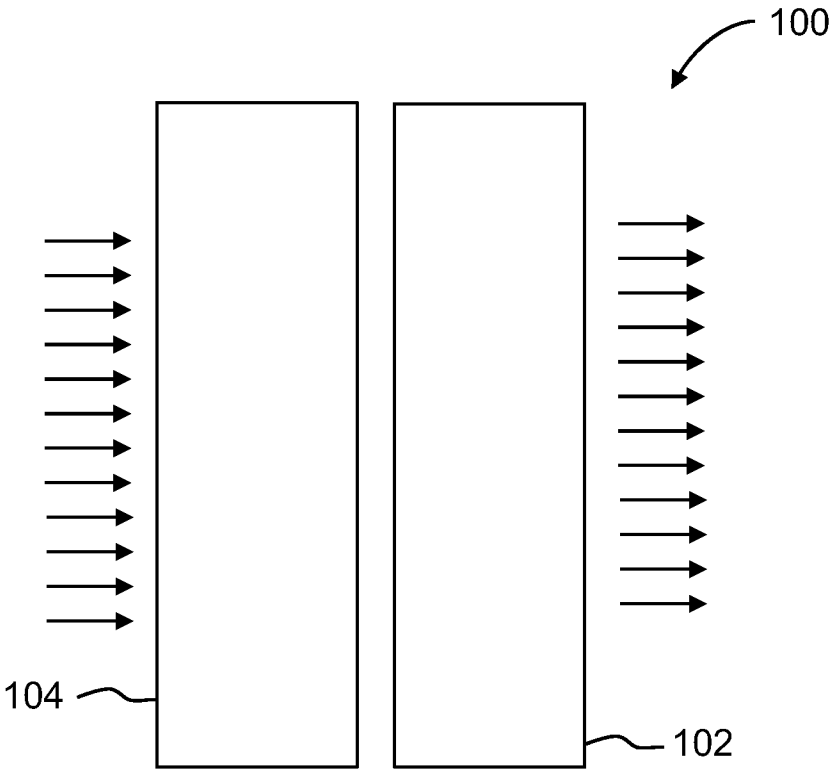
FIG. 1 is a schematic view of a heat transfer system having a heat exchanger and a fan assembly, in accordance with one embodiment of the present disclosure.

Referring to FIG. 1, a heat transfer system 100 including a fan assembly 104 is shown, in accordance with one embodiment of the disclosure. The heat transfer system 100 may be a heat transfer system for a vehicle to cool an engine coolant circulated through an engine to cool the engine. However, it may be appreciated that the heat transfer system 100 may be utilized for the engines in general without limiting the application area of the engine. Also, the use of the heat transfer system 100 is not limited to the engine only, and the heat transfer system may be utilized in any application to transfer heat from one fluid to another fluid or cool any component or system using air.

Figure 2A:
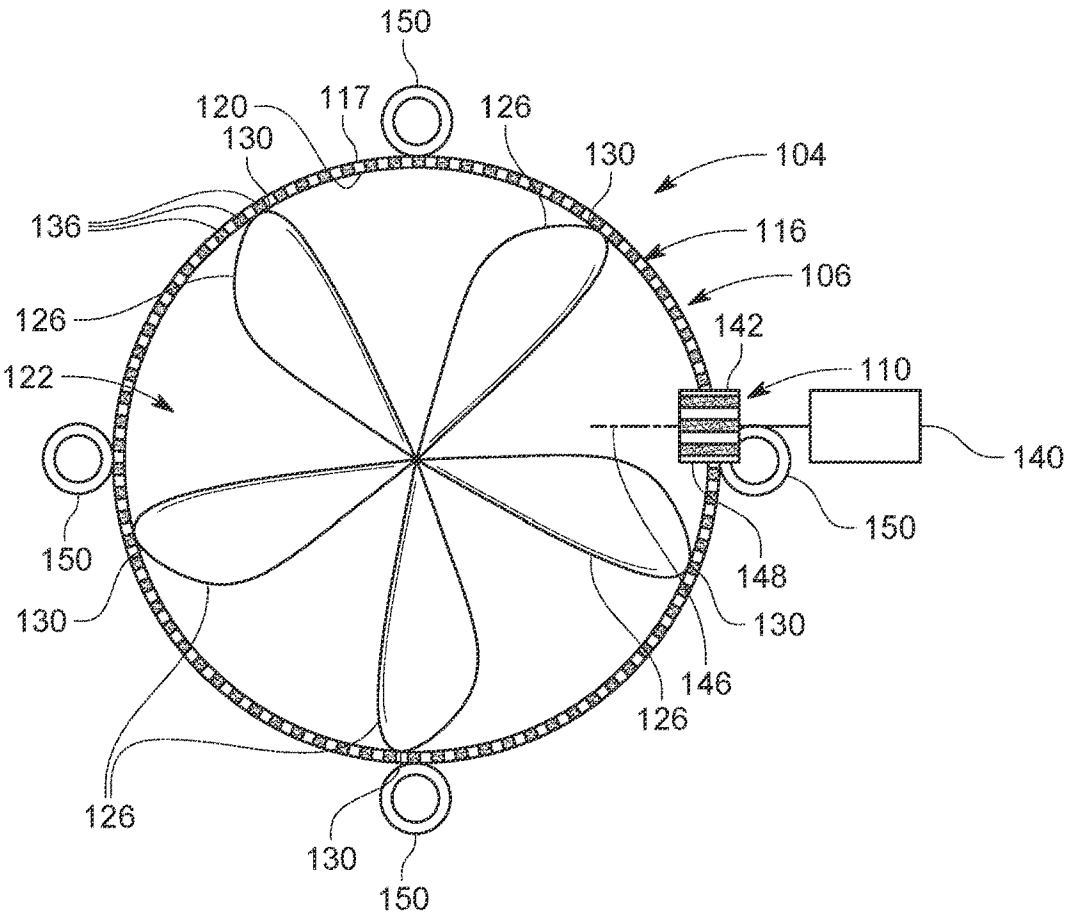
FIG. 2A is a front view of the fan assembly of FIG. 1 having a fan and a drive assembly, in accordance with one embodiment of the present disclosure.
Figure 2B:
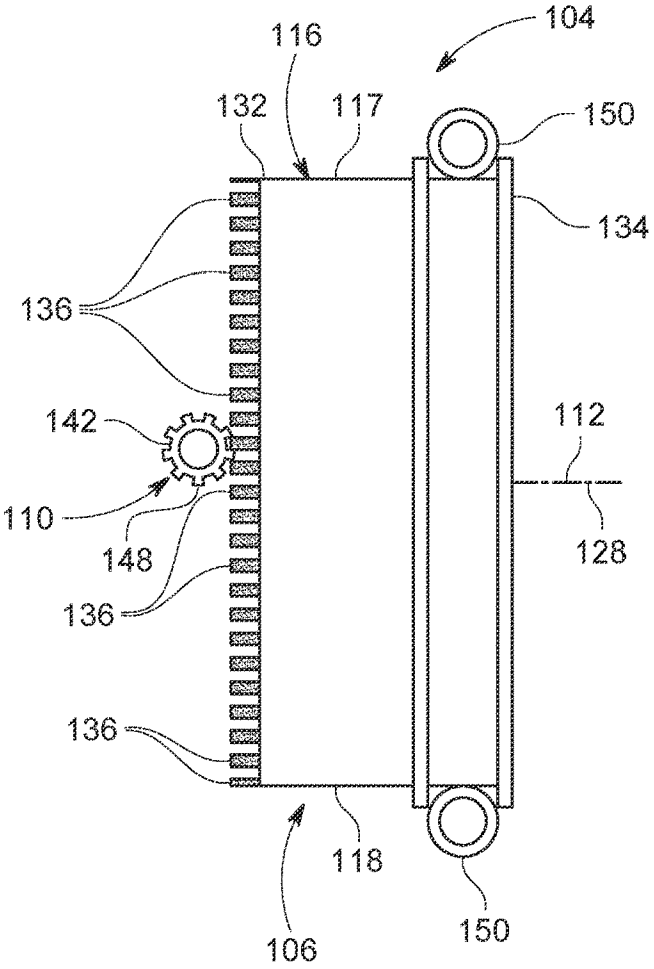
FIG. 2B is a side view of the fan assembly of FIG. 2B, in accordance with one embodiment of the present disclosure

As shown, the heat transfer system 100 includes a heat exchanger 102 configured to facilitate an exchange of heat between an air flowing across the heat exchanger 102 and a fluid flowing inside various conduits of the heat exchanger 102. To facilitate the flow of air across the heat exchanger the heat transfer system 100 includes the fan assembly 104 arranged upstream or downstream of the heat exchanger 102 in the direction of flow of the air. Referring to FIGS. 2A and 2B, the fan assembly 104 includes a fan 106 configured to generate the flow of air and provide the flow of air to the heat exchanger 102, and a drive assembly 110 operatively coupled to the fan 106 to rotate the fan 106 about its central axis 112.

As shown, the fan 106 includes a shroud 116 having a body 117 including a hollow cylindrical shape and having an outer surface 118 and an inner surface 120 defining a flow chamber 122 through which the air passes. The fan 106 also includes a plurality of blades 126 arranged inside the flow chamber 122 and arrayed circularly inside the flow chamber 122 about a central axis 128 of the shroud 116 (i.e., central axis 112 of the fan 106). As shown, the blades 126 extend radially inwardly from inner surface 120 of the shroud 116 towards the central axis 112 of the fan 102 and are connected to the shroud 116 (i.e., body 117). As shown, tip ends 130 of the blades 126 are arranged connected to the inner surface 120 of the body 117. Further, the shroud 116 includes a first longitudinal end 132 and a second longitudinal end 134, and includes a plurality of teeth 136 arrayed along an outer circumference of the body 117. As shown, the teeth 136 extend in a direction substantially parallel to the central axis 128 of the shroud 116 and are arranged at either the first longitudinal end 132 or the second longitudinal end 134 of the shroud 116. In some embodiments, the positioning of the teeth 136 at either of the longitudinal ends 132, 134 may depend on the positioning of the fan assembly 104 (i.e., the fan 106) relative to the heat exchanger 102. For example, the teeth 136 may be disposed at the first longitudinal end 132 when the fan 106 is arranged upstream of the heat exchanger 102, while the teeth 136 may be arranged at the second longitudinal end 134 when the fan 106 is disposed downstream of the heat exchanger 102.

To drive the fan 106 and hence rotate the fan 106 about the central axis 112 and to generate the flow or air, the drive assembly 110 is operatively coupled to the teeth 136. The drive assembly 110 is arranged outside the shroud 116 (i.e., the flow chamber 122) and includes a motor 140 and at least one gear, for example, a single gear 142, coupled to the motor 140 and engaged with the teeth 136. The motor 140 drives the gear 142 which in turn rotates the fan 106 about the central axis 112, generating the air flow. As illustrated, the gear 142 is arranged such that a rotational axis 146 of the gear 142 is arranged substantially perpendicularly to the central axis 112 of the fan 106. In some embodiments, to enable the transfer of rotation in a perpendicular direction, the gear 142 may be a bevel gear 148.

The motor 140 drives the drive gear 142 which in turn rotates the fan 106 about the central axis 112, generating the air flow. As illustrated, the gear 142 is arranged such that a rotational axis 146 of the gear 142 is arranged substantially perpendicularly to the central axis 112 of the fan 106. In some embodiments, to enable the transfer of rotation in a perpendicular direction, the gear 142 may be a bevel gear 148. Although the gear 142 is shown and contemplated as the bevel gear, it may be appreciated that the gear may be spur gear or any other similar gear having an axis of rotation substantially parallel to the central axis of the fan. Additionally, to rotationally support the fan 106, the fan assembly 106 includes a plurality of bearings 150 arranged outside the shroud 116 and contacting the outer surface 118 of the body 117.

Figure 3A:
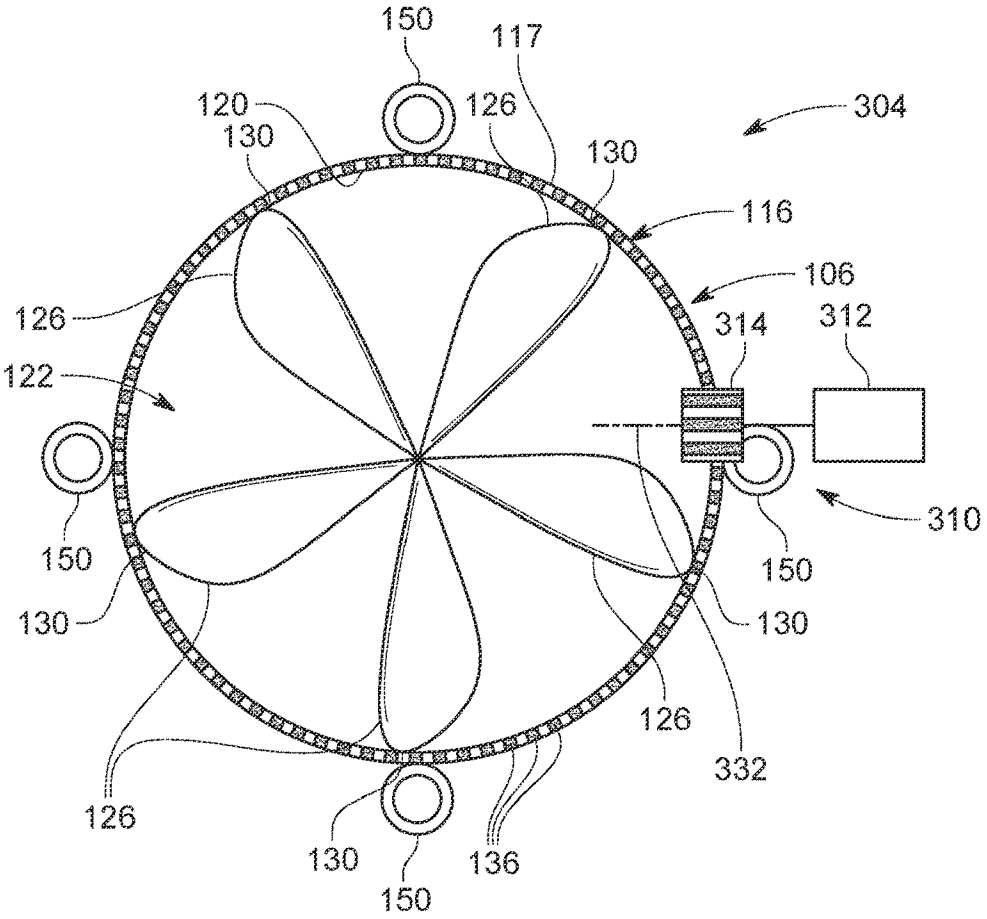
FIG. 3A is a front view of a fan assembly having the fan and a drive assembly, in accordance with one embodiment of the present disclosure.
Figure 3B:
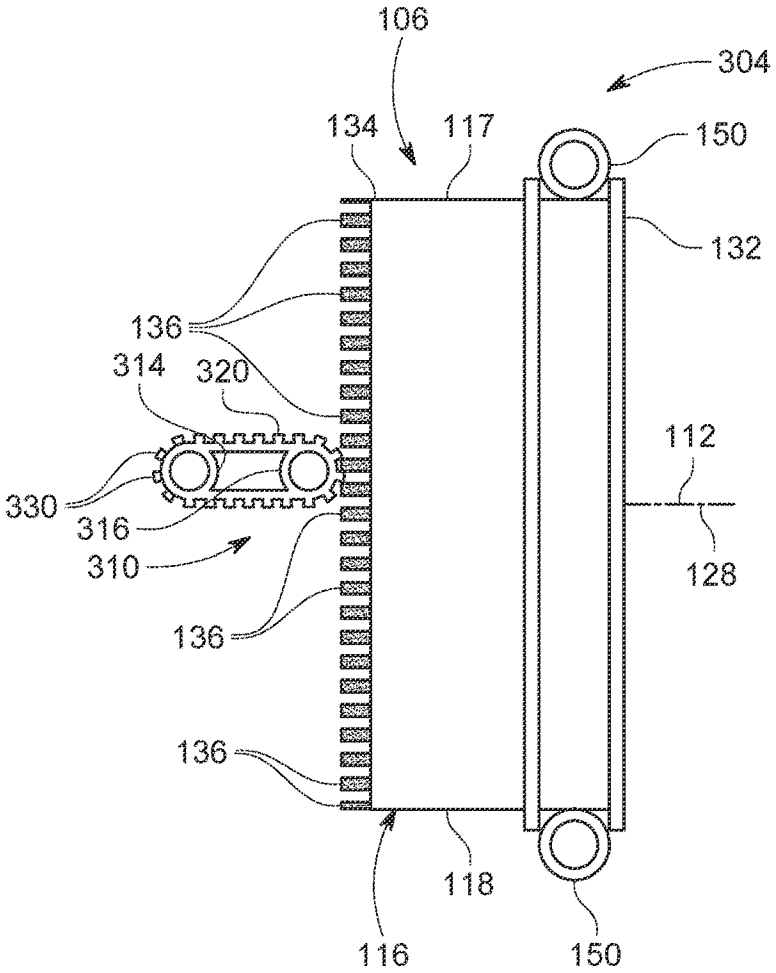
FIG. 3B is a side view of the fan assembly of FIG. 3A, in accordance with one embodiment of the present disclosure.

Referring to FIGS. 3A and 3B, a fan assembly 304 according to an alternative embodiment is shown. The fan assembly 304 is similar to the fan assembly 104 except that a drive assembly 310 of the fan assembly 204 is different from the drive assembly 110 of the fan assembly 104. As shown, the drive assembly 310 includes a motor 312, a first roller 314 coupled to the motor 312 and driven by the motor 312, a second roller 316 arranged spaced apart from the first roller 314, and a belt 320 rotatably coupling the first roller 314 with the second roller 316 and configured to rotate the second roller 316 in response to the rotation of the first roller 314. Accordingly, the belt 320 is supported on the first roller 314 and the second roller 316, and is arranged around the first roller 314 and the second roller 316. Moreover, the belt 320 includes a plurality of teeth 330 disposed in engagement with the teeth 136 of the fan 106, and enables the rotation of the fan 106 in response to the movement of the belt 320. Moreover, as shown, the first roller 314 and the second roller 316 are arranged such that the belt 320 moves in a direction substantially parallel to the central axis 112 of the fan 106, and a central axis 332 of the first roller 314 and a central axis of the second roller 316 are disposed substantially perpendicularly to the central axis 112 of the fan 106.

Figure 4A:
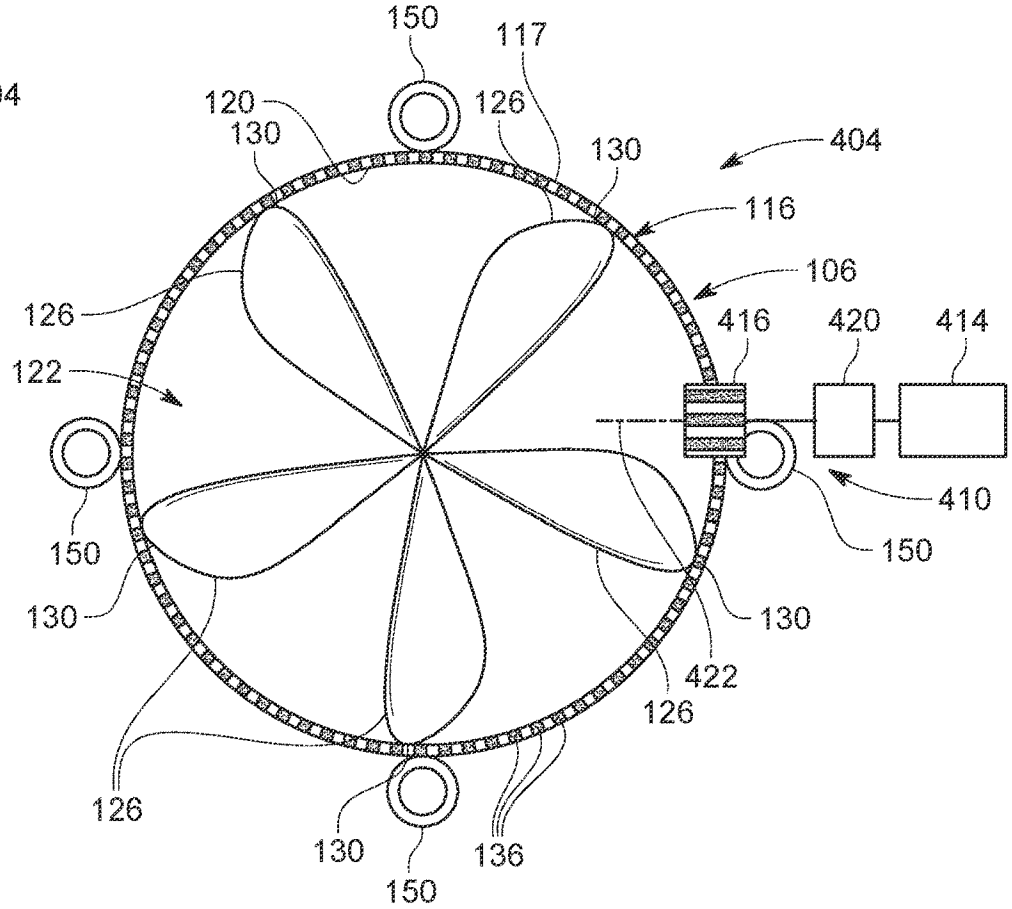
FIG. 4A is a front view of a fan assembly having the fan and a drive assembly, in accordance with one embodiment of the present disclosure.
Figure 4B:
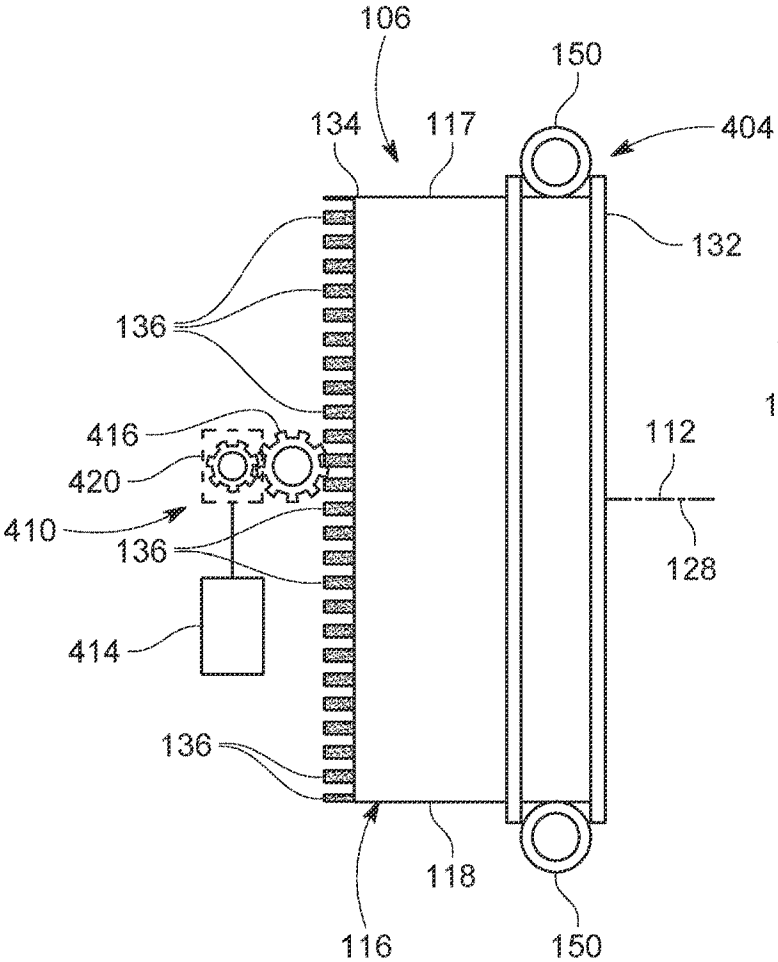
FIG. 4B is a side view of the fan assembly of FIG. 4A, in accordance with one embodiment of the present disclosure.

Referring to FIGS. 4A and 4B, a fan assembly 404 accordingly yet another embodiment is shown. The fan assembly 404 is similar to the fan assembly 104 except that a drive assembly 410 of the fan assembly 404 is different from the drive assembly 110 of the fan assembly 104. As shown, the drive assembly 410 includes a motor 414, a gear 416 engaged with the plurality of teeth 136 of the shroud 116, and a gearbox 420 operatively coupling the motor 414 to the gear 416 and configured to transfer rotational motion of a motor shaft of the motor 414 to the gear 416. Also, the gearbox 420 may include a plurality of drive gears and a plurality of driven gears selectively engageable with the plurality of drive gears to rotate the gear 416, and hence the fan 106, at a plurality of speeds. By changing a gear ratio to a desired gear ratio of the gear box 420, the speed of the fan 106 can be modulated to a desired speed. Further, as shown in FIG. 1, the gear 416 may be arranged such that a rotational axis 422 of the gear 416 is arranged substantially perpendicularly to the central axis 112 of the fan 106.

Figure 5A:
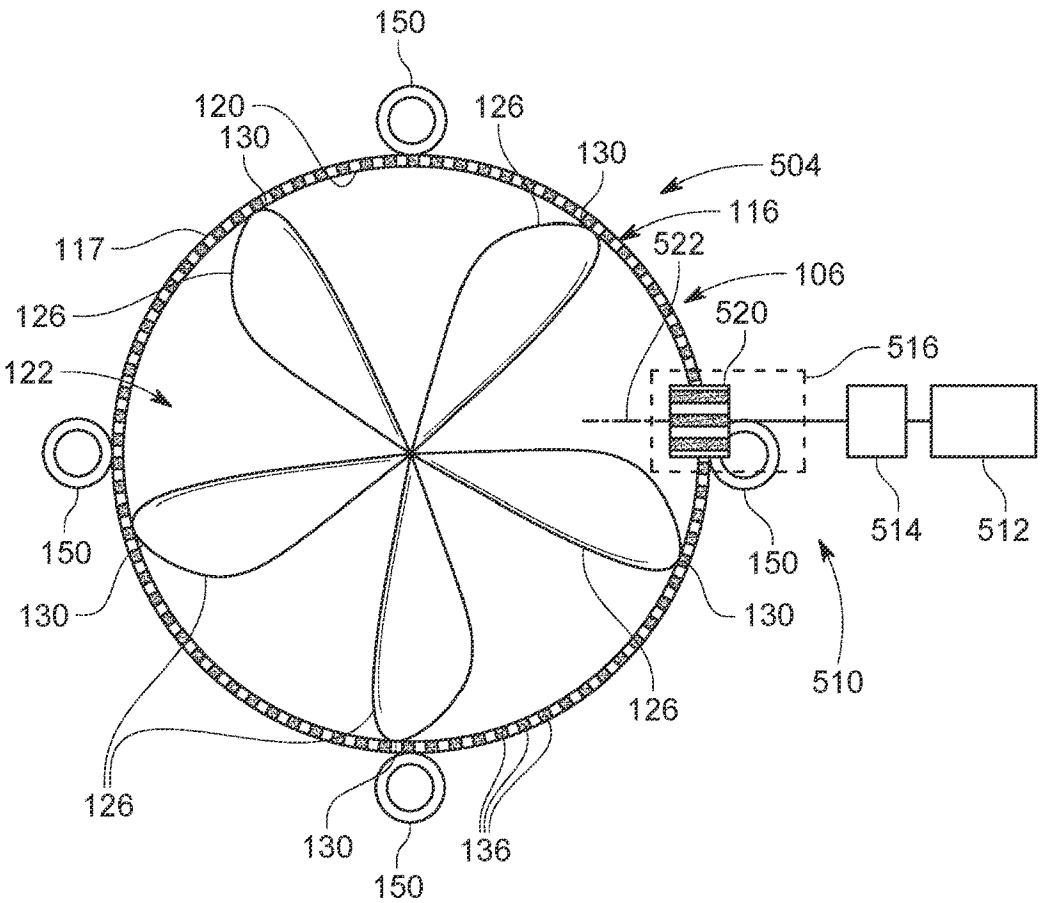
FIG. 5A is a front view of a fan assembly having the fan and a drive assembly, in accordance with one embodiment of the present disclosure.
Figure 5B:
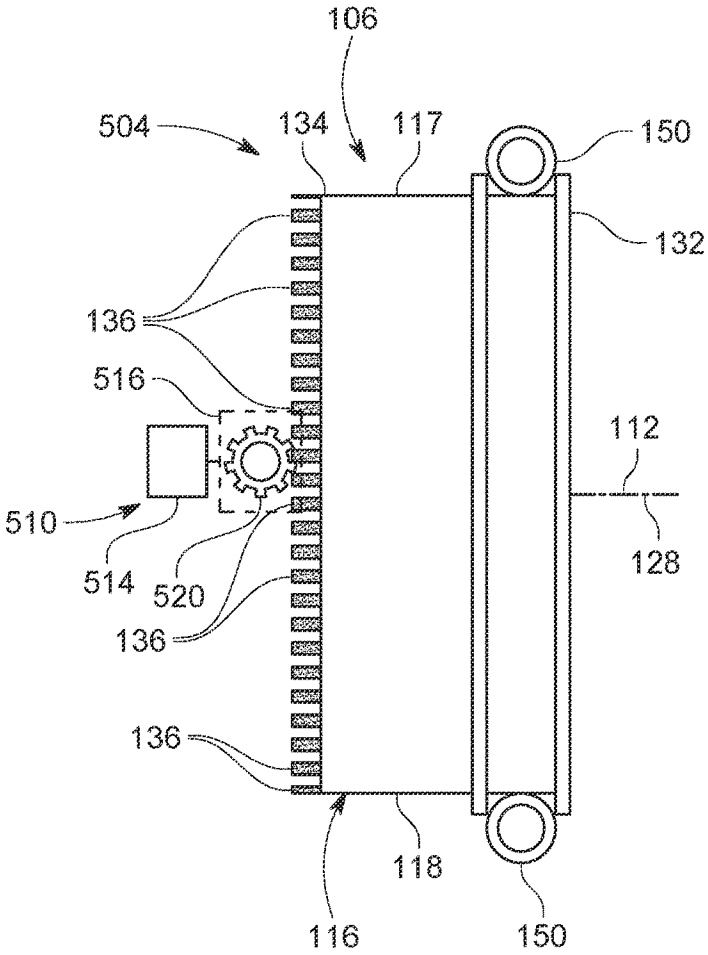
FIG. 5B is a side view of the fan assembly of FIG. 5A, in accordance with one embodiment of the present disclosure.

Referring to FIGS. 5A and 5B, a fan assembly 504 according to another embodiment is shown. The fan assembly 504 is similar to the fan assembly 104 except that a drive assembly 510 of the fan assembly 504 is different from the drive assembly 110 of the fan assembly 104. As schematically shown, the drive assembly 504 includes a motor 512 and at least one gear, for example, a drive gear 514 coupled to the motor 512 and a spider 516 operatively coupling the drive gear 514 with the teeth 136 of the shroud 116. In an embodiment, the spider 516 includes one or more spider gears (not shown) and a driven gear 520 coupled with the one or more spider gears and the plurality of teeth 136 of the shroud 116. Accordingly, the spider 516 rotates the fan 106 in response to the rotation of the drive gear 514 by the motor 512. In an embodiment, an axis 522 of rotation of the driven gear 520 is substantially perpendicular to the central axis 112 of the fan 106. In some embodiments, the drive gear 514 and the spider 516 are arranged and assembled such that the axis of rotation of the drive gear 514 is substantially parallel to the central axis 112 of the fan 106.

Figure 6A:
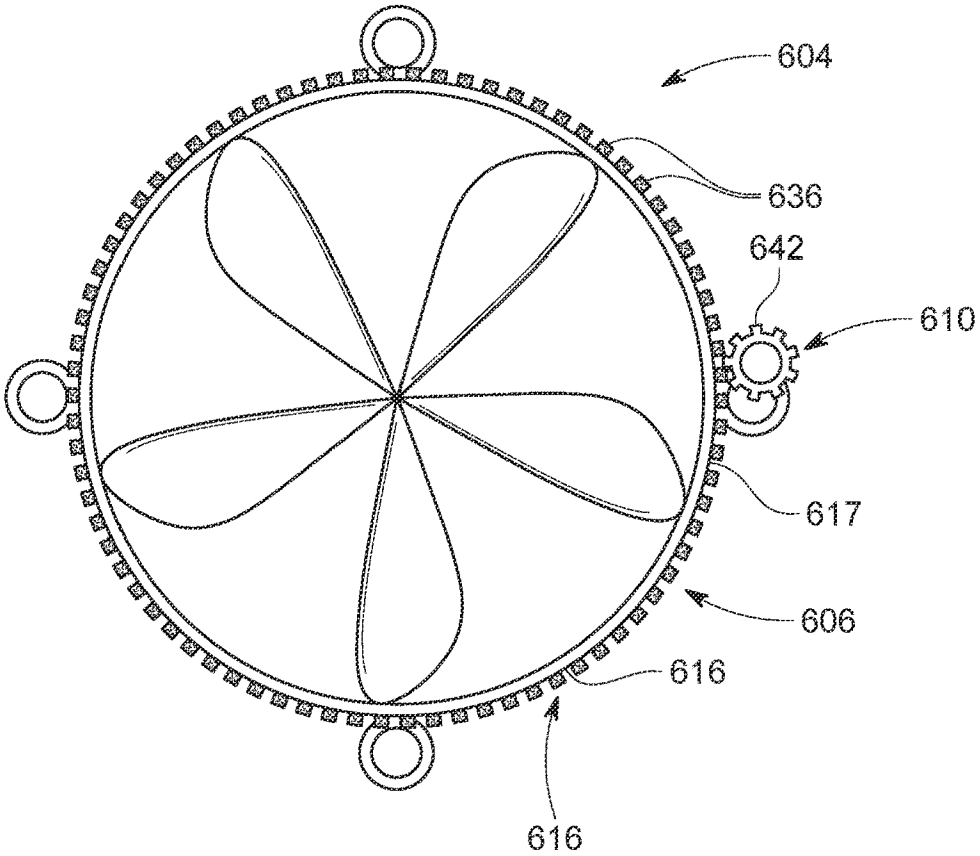
FIG. 6A is a front view of a fan assembly having a fan and a drive assembly, in accordance with one embodiment of the present disclosure.
Figure 6B:
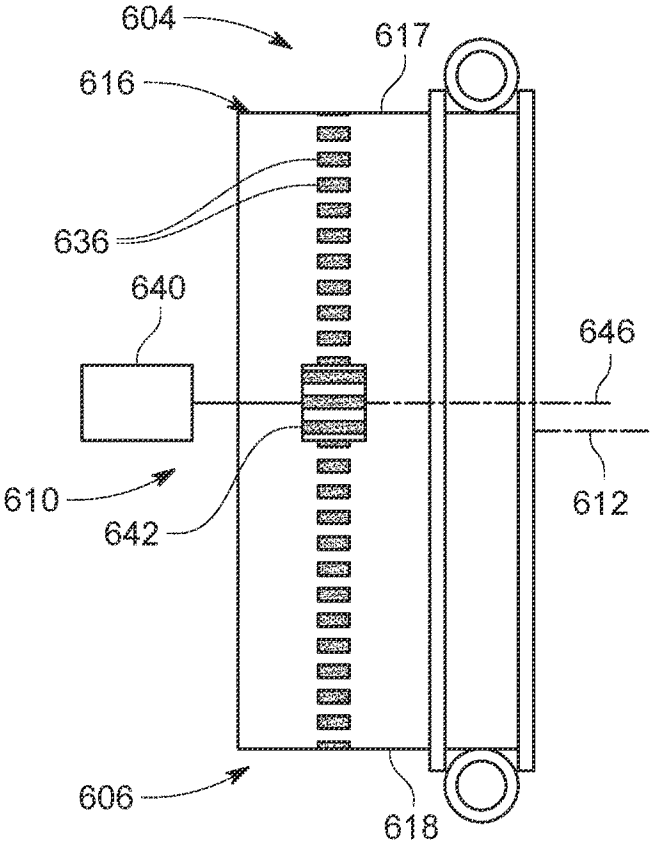
FIG. 6B is a side view of the fan assembly of FIG. 6A, in accordance with one embodiment of the present disclosure.

Referring to FIGS. 6A and 6B, a fan assembly 604 according to another embodiment is shown. The fan assembly 604 is similar to the fan assembly 104 except that a fan 606 of the fan assembly 604 is different from the fan 106 of the fan assembly 104 such that a plurality of teeth 636 of the fan 606 extends radially outwardly from an outer surface 618 of a body 617 of a shroud 616 of the fan 606 rather than the plurality of teeth 116 that extends in a direction substantially parallel to the central axis 112 of the fan 106. Also, a drive assembly 610 of the fan assembly 604 is similar to drive assembly 110 of the fan assembly 104 except that a position of the drive assembly 610 is different from the position of the drive assembly 110. As shown, the drive assembly 610 includes a motor 640 and at least one gear, for example, a single gear 642, coupled to the motor 640 and engaged with the teeth 636. The motor 640 drives the gear 642 which in turn rotates the fan 606 about a central axis 612, generating the air flow. As illustrated, the gear 642 is arranged such that a rotational axis 646 of the gear 642 is arranged substantially parallel to the central axis 612 of the fan 606. In some embodiments, the central axis of the gear 642 may be arranged substantially perpendicularly to the central axis 612 of the fan 106. To enable the transfer of rotation in a perpendicular direction, the gear 642 may be a bevel gear.

Although the fan assemblies 304, 404, 504 are contemplated to include the fan 106 having plurality of teeth 136 that extend in direction substantially parallel to the central axis of the fan 106, it may be appreciated that the fan assemblies 304, 404, 504 are modified in a manner similar to the fan assembly 604 to include a fan similar to the fan 606 having plurality of teeth extending radially outwardly of an outer surface of body of the shroud. In such a case, the drive assemblies 310, 410, 510 are positioned relative to the fan 106 in a manner similar to the position of the drive assembly 610 relative to fan 606. It may be appreciated that the drive assembly 110, 310, 410, 510, 610 is arranged relative to the fan 106, 606 such that the components of the drive assembly 110, 310, 410, 510, 610 are arranged proximate to and outside, at least partially, the body both in the longitudinal direction as well radial direction. As the drive assembly 110, 310, 410, 510, 610 are arranged outside the shroud 116, 616 (i.e., the flow chamber 122), the interference of the drive assembly with the air flow generated by the fan is minimized, leading to an efficient fan assembly and heat transfer system.

Although the fan assembly 104, 304, 404, 504, 604 is contemplated and explained with reference to a heat transfer system 100, it may be envisioned that the fan assembly 104, 304, 404, 504, 604 may be utilized in any other application areas, such as, but not limited to, a propulsion system for a vehicle, a fluid circulation pump, or any other suitable application areas known in the art. Further, the fan assembly 104, 304, 404, 504, 604, may facilitate the circulation of a fluid or air over one or more components or inside a chamber without the heat exchanger 102.

The foregoing description of embodiments and examples has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate certain principles and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A fan assembly, comprising:
- a fan having
  - a shroud including
    - a body having an inner surface defining a flow chamber, and
    - a plurality of teeth arrayed circularly around a circumference of the body, wherein the plurality of teeth extends outwardly from an end of the body in a direction parallel to a central axis of the shroud,
  - a plurality of blades arranged circularly around a central axis of the fan and extending radially inwardly from the shroud towards the central axis of the fan, wherein each of the plurality of blades is arranged inside the flow chamber and includes an outer edge connected to the inner surface of the shroud; and
- a drive assembly arranged outside the shroud and operatively engaged with the plurality of teeth of the shroud to rotate the fan around the central axis.

2. The fan assembly of claim 1, wherein the fan assembly includes a plurality of bearings arranged outside the shroud, contacting the outer surface of the shroud and configured to rotatably support the fan.

3. The fan assembly of claim 1, wherein the drive assembly includes
- at least one gear operatively coupled to the plurality of teeth of the shroud, and
- a motor operatively coupled to the at least one gear to rotate the gear.

4. The fan assembly of claim 3, wherein the at least one gear includes a bevel gear.

5. A heat transfer system, comprising:
- a heat exchanger;
- a fan configured to facilitate a flow of air through the heat exchanger and including
  - a shroud including
    - a body having an inner surface defining a flow chamber, and
    - a plurality of teeth arrayed circularly around a circumference of the body, wherein the plurality of teeth extends outwardly from an end of the body in a direction parallel to a central axis of the shroud, and
  - a plurality of blades arranged circularly around a central axis of the fan and extending radially inwardly from the shroud towards the central axis of the fan, wherein each of the plurality of blades is arranged inside the flow chamber and includes an outer edge connected to the inner surface of the shroud; and
- a drive assembly arranged outside the shroud and operatively engaged with the plurality of teeth of the shroud to rotate the fan around the central axis.

6. The heat transfer system of claim 5 further including a plurality of bearings arranged outside the shroud, contacting the outer surface of the shroud and configured to rotatably support the fan.

7. The heat transfer system of claim 5, wherein the drive assembly includes
- at least one gear operatively coupled to the plurality of teeth of the shroud, and
- a motor operatively coupled to the at least one gear to rotate the gear.

8. The heat transfer system of claim 7, wherein the at least one gear includes a bevel gear.

9. A fan assembly, comprising:

a fan having a shroud including a body having an inner surface defining a flow chamber, and a plurality of teeth arrayed circularly around a circumference of the body, wherein the plurality of teeth extends outwardly from an end of the body in a direction parallel to a central axis of the shroud, a plurality of blades arranged circularly around a central axis of the fan and extending radially inwardly from the shroud towards the central axis of the fan, wherein each of the plurality of blades is arranged inside the flow chamber and includes an outer edge connected to the inner surface of the shroud; and a drive assembly arranged outside the shroud and including a gear arranged outside the shroud and operatively coupled with the plurality of teeth of the shroud to facilitate a rotation of the fan around the central axis.

10. The fan assembly of claim 9, wherein the fan assembly includes a plurality of bearings arranged outside the shroud, contacting the outer surface of the shroud and configured to rotatably support the fan.

11. The fan assembly of claim 9, wherein the gear includes a bevel gear.

* * * * *